US006067667A

United States Patent [19]

Suzuki

[11] Patent Number: 6,067,667

[45] Date of Patent: May 30, 2000

[54] SEMI-AUTOMATIC CLOSING DEVICE FOR SEAT LID OF TOILET BOWL

[75] Inventor: Naokazu Suzuki, Kanagawa, Japan

[73] Assignee: Katoh Electrical Machinery Co., Ltd., Kanagawa, Japan

[21] Appl. No.: 09/148,676

[22] Filed: Sep. 4, 1998

[30] Foreign Application Priority Data

Sep. 9, 1997 [JP] Japan ..... 9-244495

[51] Int. Cl.[7] ..... A47K 13/10

[52] U.S. Cl. ..... 4/246.1; 4/246.2; 4/248

[58] Field of Search ..... 4/246.1, 246.2, 4/248, 253, 246.3, 246.4, 246.5

[56] References Cited

U.S. PATENT DOCUMENTS

| | | | |
|---|---|---|---|
| 2,200,687 | 5/1940 | Bercot | 4/246.1 |
| 4,995,120 | 2/1991 | Tager | 4/246.1 |
| 5,664,286 | 9/1997 | Sorimachi | 4/246.2 |
| 5,768,718 | 7/1998 | Sorimachi | 4/246.2 |
| 5,878,444 | 3/1999 | Convoy | 4/246.1 |

FOREIGN PATENT DOCUMENTS

| | | | |
|---|---|---|---|
| 5-137665 | 6/1993 | Japan | 4/246.1 |
| 5-121758 | 5/1994 | Japan | 4/248 |
| 6-121759 | 5/1994 | Japan | 4/248 |

*Primary Examiner*—Charles R. Eloshway
*Attorney, Agent, or Firm*—Notaro & Michalos P.C.

[57] ABSTRACT

A semi-automatic toilet bowl seat and seat lid operator, comprising a hinge case to be installed to a toilet bowl body; a rotating shaft to support a seat and seat lid of the toilet bowl openably and closably; an output gear mounted on the rotating shaft; a fluid damper having a damper gear in mesh with the output gear; a reduction gear coupled to the output gear by means of a torque limiter; a motor coupled to the reduction gear; and a drive circuit to drive the motor in a range from an opened angle, to a predetermined closed angle, of the seat and seat lid. The drive circuit is provided with a sensor to detect an operation made to open the seat and seat lid, and a timer which is turned on by the sensor to turn on the drive circuit in a predetermined time after the sensor is turned on. The seat and seat lid of the toilet bowl can be opened and closed by hand, and the opened seat and seat lid can be automatically closed slowly with the semi-automatic operator.

4 Claims, 6 Drawing Sheets

SEMI-AUTOMATIC CLOSING DEVICE FOR SEAT LID OF TOILET BOWL

BACKGROUND OF THE INVENTION

1. Field of the Invention

The present invention relates to a semi-automatic operator for a seat and seat lid of a toilet bowl.

2. Description of the Prior Art

Operators for a toilet bowl seat and seat lid having so far been proposed include an automatic type and a semi-automatic type. In a typical one of the automatic operators, a motor is employed to automatically open and close the seat and seat lid. With a typical manual operator, the seat and seat lid are opened by hand, but when they are closed, a damper is activated to prevent the seat and seat lid from falling suddenly, namely, for gradual closing of them.

The conventional automatic operator needs a motor which can provide a necessary torque for operating, or opening and closing, the seat and seat lid. The motor is correspondingly large and expensive for such an ability, and hence will add to the size and costs of the automatic operator.

The conventional manual operator can advantageously be manufactured with less costs. However, not few users forget to close the seat and seat lid after using the toilet bowl. A next user will feel discomfort to see it.

SUMMARY OF THE INVENTION

Accordingly, the present invention has an object to overcome the above-mentioned drawbacks of the prior art by providing a compact semi-automatic operator for a seat and seat lid of a toilet bowl, which can be manufactured with as small costs as possible and prevent the user from forgetting to close the seat and seat lid after using the toilet bowl.

The above object can be accomplished by providing a semi-automatic toilet bowl seat and seat lid operator, comprising, according to the present invention, a hinge case to be installed to a toilet bowl body, a rotating shaft to support a seat and seat lid of the toilet bowl openably and closably, an output gear mounted on the rotating shaft, a fluid damper having a damper gear in mesh with the output gear, a reduction gear coupled to the output gear by means of a torque limiter, a motor coupled to the reduction gear, and a drive circuit to drive the motor in a range from an opened angle, to a predetermined closed angle, of the seat and seat lid, the drive circuit being provided with a sensor to detect an operation made to open the seat and seat lid, and a timer which is turned on by the sensor to turn on the drive circuit in a predetermined time after the sensor is turned on.

The above object can also be accomplished by providing a semi-automatic toilet bowl seat and seat lid operator, comprising, according to the present invention, a hinge case to be installed to the toilet bowl body, a rotating shaft mounted on the hinge case, an output shaft inserted axially in the rotating shaft to secure one end of the seat and seat lid and support the other end of the seat and seat lid rotatably, an output gear mounted on the rotating shaft, a fluid damper having a damper gear in mesh with the output gear, a reduction gear coupled to the output gear by means of a torque limiter, a motor coupled to the reduction gear, and a drive circuit to drive the motor in a range from an opened angle, to a predetermined closed angle, of the seat and seat lid, the drive circuit being provided with a sensor to detect an operation made to open the seat and seat lid, and a timer which is turned on by the sensor to turn on the drive circuit in a predetermined time after the sensor is turned on.

In any case, the torque limiter may be composed of a torque transmission gear of the reduction gear, rotatably mounted on the rotating shaft having the output gear mounted thereon, and a compression spring wound on the rotating shaft to press the transmission gear to the output gear.

BRIEF DESCRIPTION OF THE DRAWINGS

These objects and other objects, features, aspects and advantages of the present invention will become more apparent from the following detailed description of the present invention when taken in conjunction with the accompanying drawings, of which.

DETAILED DESCRIPTION OF THE PREFERRED EMBODIMENTS

Figure 1:
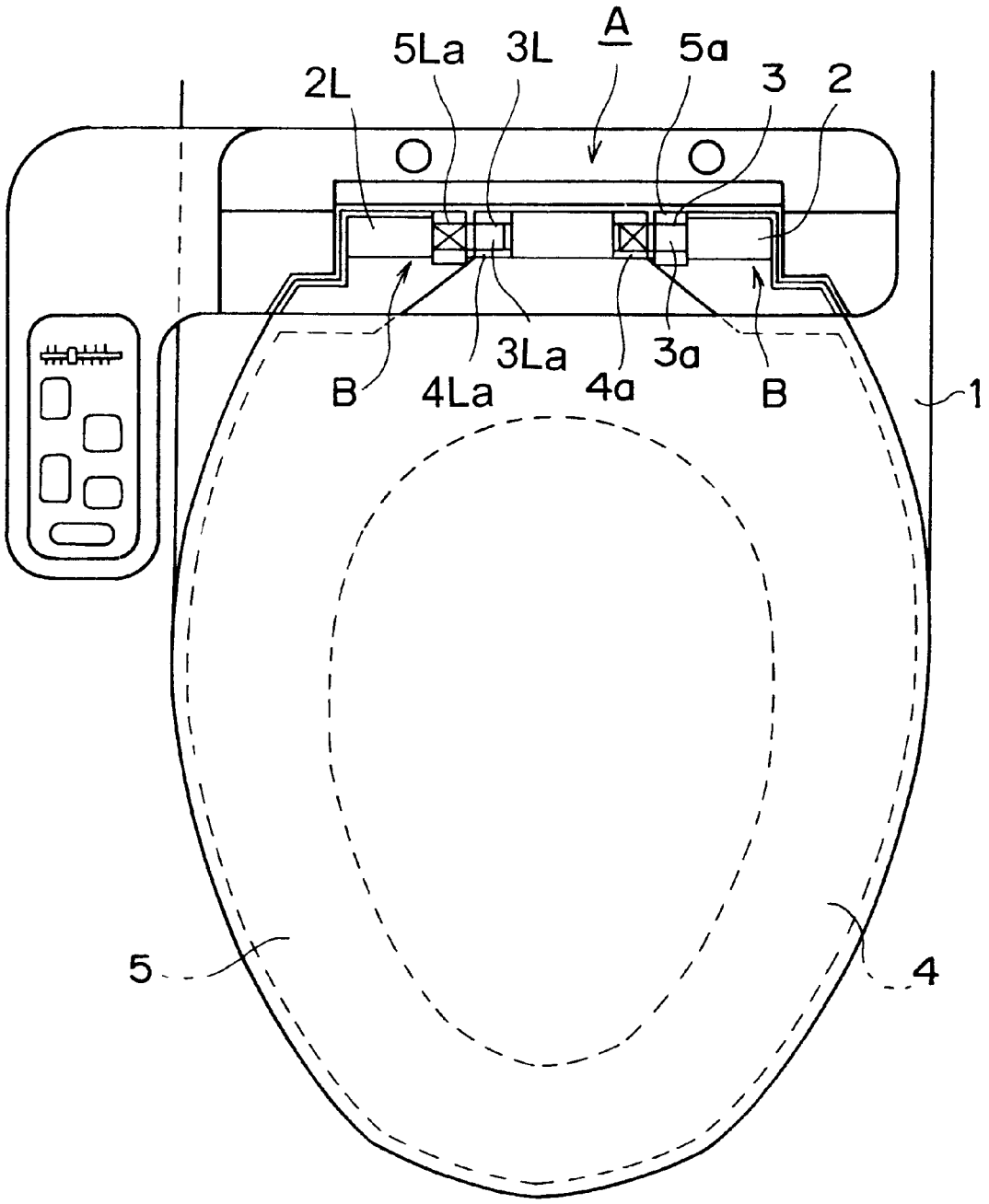
FIG. 1 is a plan view of the semi-automatic toilet bowl seat and seat lid operators according to the present invention, installed on a toilet bowl body.
Figure 2:
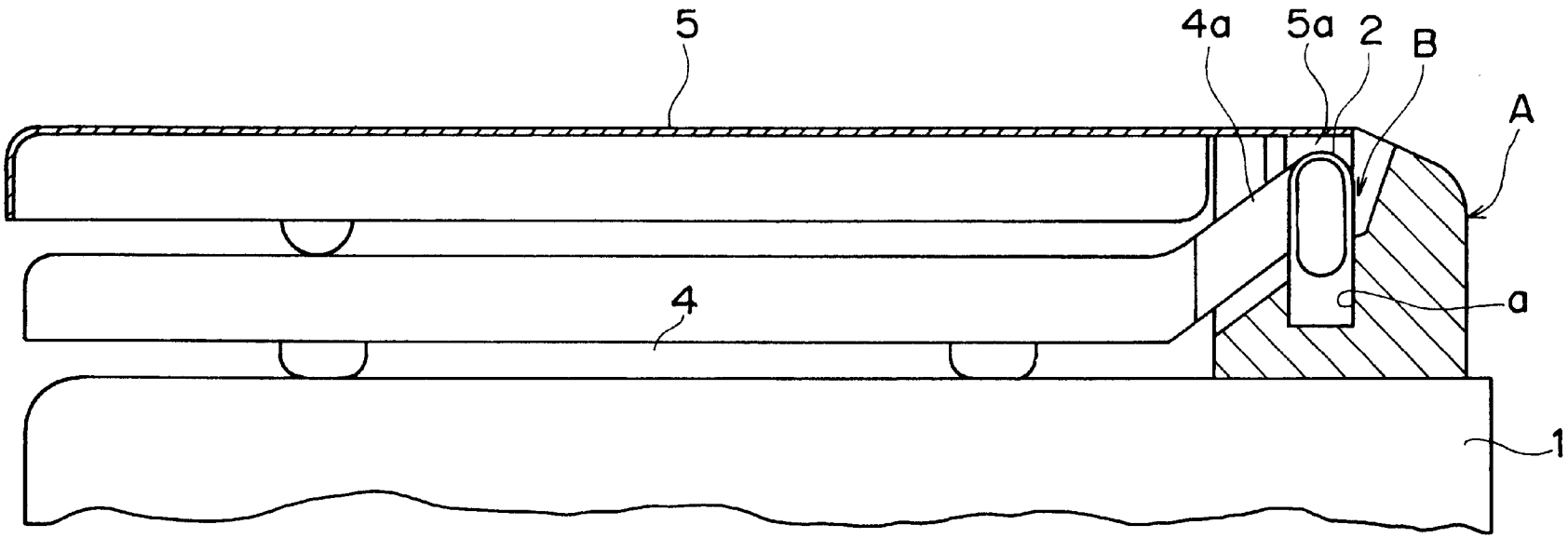
FIG. 2 is a fragmentary axial-sectional view of the semi-automatic operator and toilet bowl seat and seat lid in FIG. 1.

The present invention will be described first with reference to FIGS. 1 and 2. FIG. 1 is a plan view of the semi-automatic toilet bowl seat and seat lid operators according to the present invention, installed on the body of a toilet bowl, and FIG. 2 is a fragmentary axial-sectional view of the semi-automatic operator and toilet bowl seat and seat lid in FIG. 1. As shown, there is installed a mount base A of the semi-automatic operator on top of the rear end portion of a toilet bowl body 1. The mount base A has fixation holes a formed vertically therein with a predetermined space between them. Each of hinges cases 2, 2L in the pair is removably installed at the lower portion thereof in one of the holes a (only one hole shown in FIG. 2). The hinge cases 2, 2L may be secured on top of the mount base A or the toilet bowl body 1 with fixing screws or the like.

Each of the hinge cases 2, 2L houses an output shaft 3, 3L, respectively, having a substantially elliptic section. The right-side output shaft 3 has a coupling portion 3*a* projecting from one upper lateral portion of the hinge case 2 in a direction toward the other hinge case 2L. The projecting coupling portion 3*a* also has an elliptic cross section that is axially inserted into an axial through-hole formed in coupling portion 4*a* of seat 4. The axial through-hole also has a non-circular, that is, substantially elliptic, cross section. Thus, the right-side output shaft 3 rotates with the seat 4. The coupling portion 3*a* is further inserted into an axial hole having a circular cross section formed in a coupling portion 5*a* of a seat lid 5. The right-side output shaft 3 thereby rotates independently of the seat lid 5.

The coupling portion 3L*a* of the left-side output shaft 3L is inserted into an axial through-hole having a circular cross section formed in the coupling portion 4L*a* of the seat 4. The coupling portion 3L*a* further extends into an axial hole having a non-circular cross section formed in the left-side coupling portion 5L*a* of the seat lid 5. In this manner, the seat lid 5 is rotatable with the left-side output shaft 3L.

As mentioned above, two semi-automatic operators B according to the present invention are installed in pair at the right and left of the toilet bowl body 1. In the following description of the present invention, the right-side one of the semi-automatic operators B is used with the seat 4 while the left-side one is used with the seat lid 5. Of course, the right-side one may be used with the seat lid 5 and the left-side one be used with the seat 4.

Figure 3:
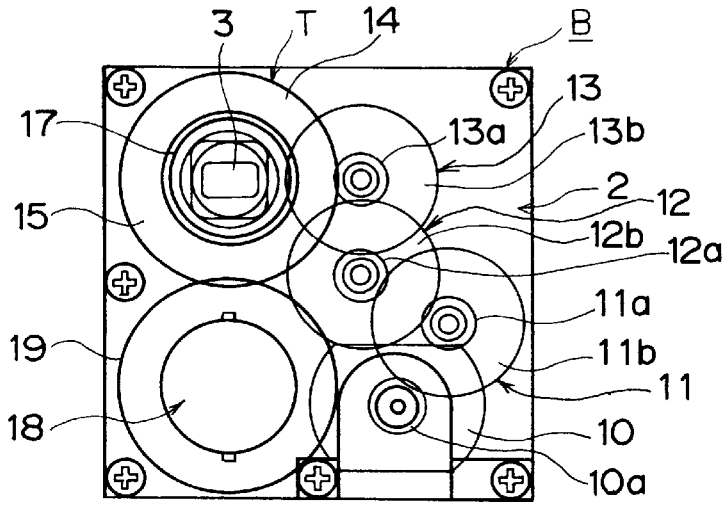
FIG. 3 is a side elevation of the right-side one of the semi-automatic operators B shown in FIG. 1.
Figure 4:
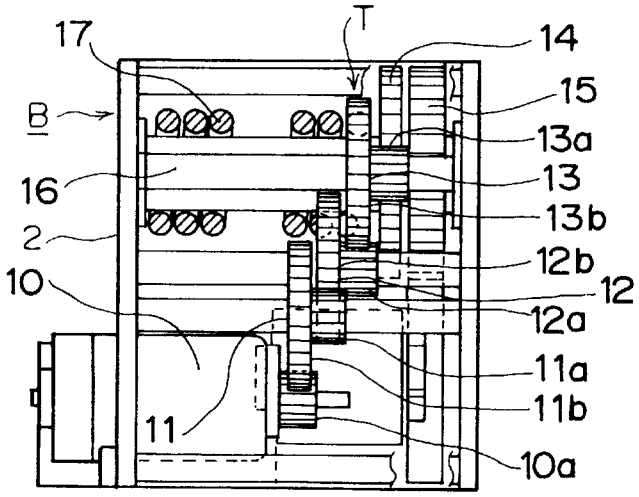
FIG. 4 is a front view of the semi-automatic operator B in FIG. 3.
Figure 5:
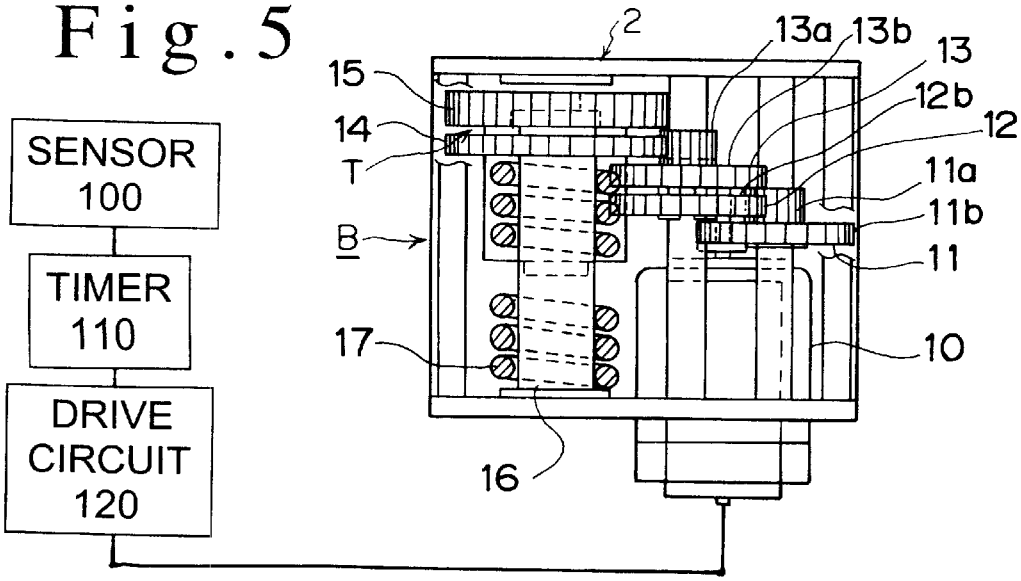
FIG. 5 is a plan view of the semi-automatic operator B in FIG. 3.

Of the semi-automatic operators B of the present invention, the right-side one will be described herebelow with reference to FIGS. 3, 4 and 5 being a side elevation, a front view, and a plan view, respectively, of the semi-automatic operator B.

As shown in these Figures, a motor 10 is provided in the hinge case 2. The motor 10 is driven to turn the seat 4 from the full open position in the closing direction until the seat 4 passes by a reversal point of the moment of the seat 4. Note that the toilet bowl with which the apparatus according to the present invention is used is of a type in which the user opens the closed seat by hand to the full open position. With the semi-automatic operator of the present invention, the motor 10 is automatically put into run in a predetermined time after the user leaves the toilet bowl with the seat 4 left opened, to close the seat 4. To this end, the apparatus according to the present invention comprises a sensor 100 to detect when the seat 4 is full opened or when the user has left the seat 4, and a timer 110 to count a predetermined length of time after the sensor detects when the seat 4 is full opened. Upon counting of the predetermined length of time, the timer will close a drive circuit 120 to put the motor 10 into action.

The semi-automatic operator B also comprises a first reduction gear 11 including two integrally formed gears 11*a* and 11*b* having different diameters. The first reduction gear 11 is rotatably born inside the hinge case 2 with the gear 11*b* having a larger diameter being in mesh with a drive gear 10*a* fixed on an output shaft of the motor 10. A spacer is used to maintain the engagement of the gear 11*b* with the drive gear 10*a*. Also a second reduction gear 12 is provided which includes two integrally formed gears 12*a* and 12*b* of different diameters. The second reduction gear 12 is rotatably born inside the hinge case 2 with the gear 12*b* having a larger diameter being in mesh with the gear 11*a* of a smaller diameter of the first reduction gear 11. Also a spacer is used to maintain the gear 12*b* engaged with the gear 11*a*. Further a third reduction gear 13 is provided including gears 13*a* and 13*b* different in diameter from each other. The third reduction gear 13 is born inside the hinge case 2 with the gear 13*b* of a larger diameter being in mesh with the gear 12*a*, having the smaller diameter, of the second reduction gear 12. Also a spacer is used to maintain the engagement of the gear 13*b* with the gear 12*a*.

A torque transmission gear 14 is in mesh with the smaller-diameter gear 13*a* of the third reduction gear 13 while being rotatably fitted on a rotating shaft 16 inserted in a central hole formed in an output gear 15. The output shaft 3 is inserted axially in the rotating shaft 16. A coil spring 17 is fitted on the rotating shaft 16 to press the torque transmission gear 14 to the output gear 15. Owing to a friction developed under the pressure of the coil spring 17, a torque is transmitted from the torque transmission gear 14 to the output gear 15. If the transmitted torque is abnormally larger than the friction, the torque transmission gear 14 will be idled to prevent an abnormally large torque from being transmitted to the output gear 15. More particularly, a torque limiter T is implemented by the mechanism in which while the coil spring 17 is pressing the torque transmission gear 14 to the output gear 15, a torque is transmitted from the torque transmission gear 14 to the output gear 15 owing to the friction developed between the torque transmission gear 14 and output gear 15. As the output gear 15 is rotated, its torque is transmitted to the seat 4 by means of the output shaft 3. The means for transmitting a torque from the torque transmission gear 14 to the output gear 15 is formed, in this embodiment, from a plurality of projections (not illustrated) disposed radially on one side of the torque transmission gear 14 and a corresponding plurality of concavities formed on one side of the output gear 15 and in which the projections are engaged. However, the present invention is not limited to the use of the friction. The torque transmitting means may be implemented by a viscous fluid or the like.

Figure 6:
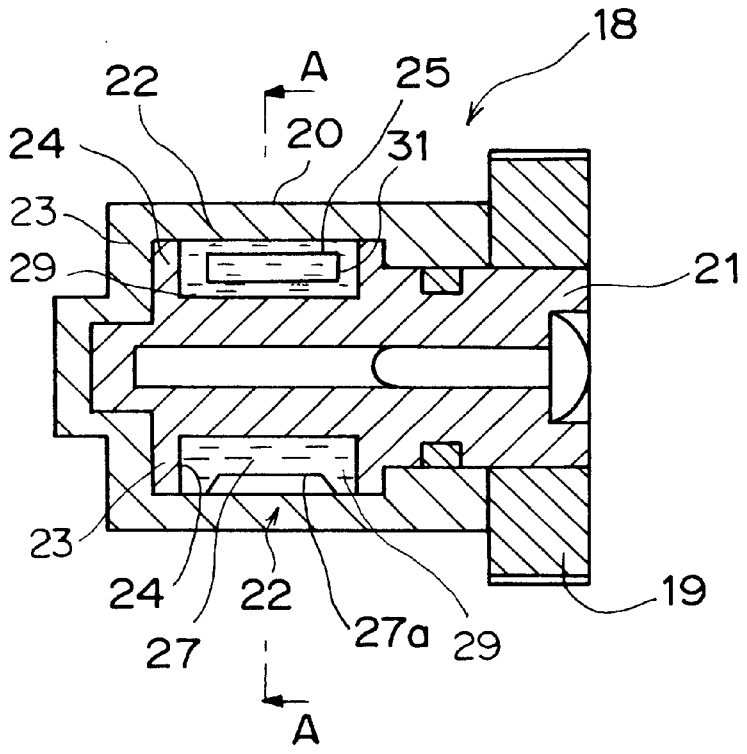
FIG. 6 is an axial sectional view of the damper.
Figure 7:
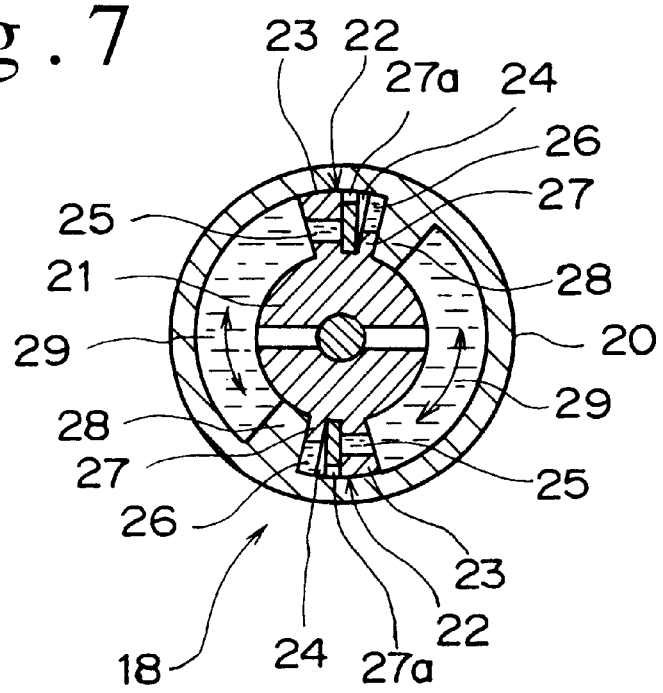
FIG. 7 is a cross-sectional view of the damper taken along the line A—A in FIG. 6.

A fluid damper 18 having a damper gear 19 is also provided in the hinge case 2. The damper gear 19 is in mesh with the output gear 15. FIGS. 6 and 7 show together the damper 18. FIG. 6 is an axial-sectional view, and FIG. 7 is a cross-sectional view, of the damper 18. The damper 18 has a case 20 in which a rotating shaft 21 is rotatably born. The rotating shaft 21 has provided substantially at the middle thereof a pair of valves 22 constructed as will be described below.

As shown in FIG. 7, each of the valves 22 includes a vane 23 projecting from the rotating shaft 21 and spaced 180 degrees from a one 23 included in the other valve assembly 22, an elongated recess 24 formed radially of the edge of the vane 23, a slot 25 formed extending from one side of the elongated recess 24 to one side of the vane 23 in the rotating direction, a cut 26 formed extending from the other side of the elongated recess 24 to the other side of the vane 23 in the rotating direction, and a valve core 27 oscillatably disposed in the elongated recess 24 and having a concavity 27*a* formed in the oscillating end portion thereof.

The damper case 20 has projected radially from the inner wall thereof a pair of stop pieces 28 which abut the surface of the rotating shaft 24 to divide by two the inner space of the damper case 20. The damper case 20 is filled with a viscous fluid 29 such as silicon oil. The damper gear 19 is fixed to a portion of the rotating shaft 21 penetrated through the side wall of the damper case 20 and engaged with the output gear 15.

Figure 8:
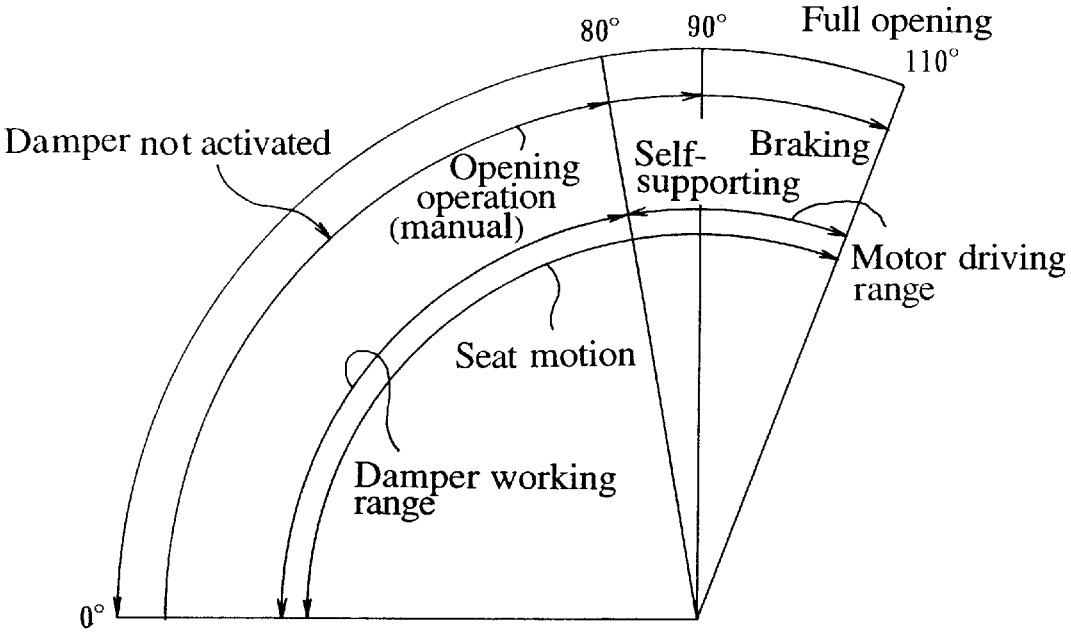
FIG. 8 is a functional chart of the semi-automatic operator.
Figure 9:
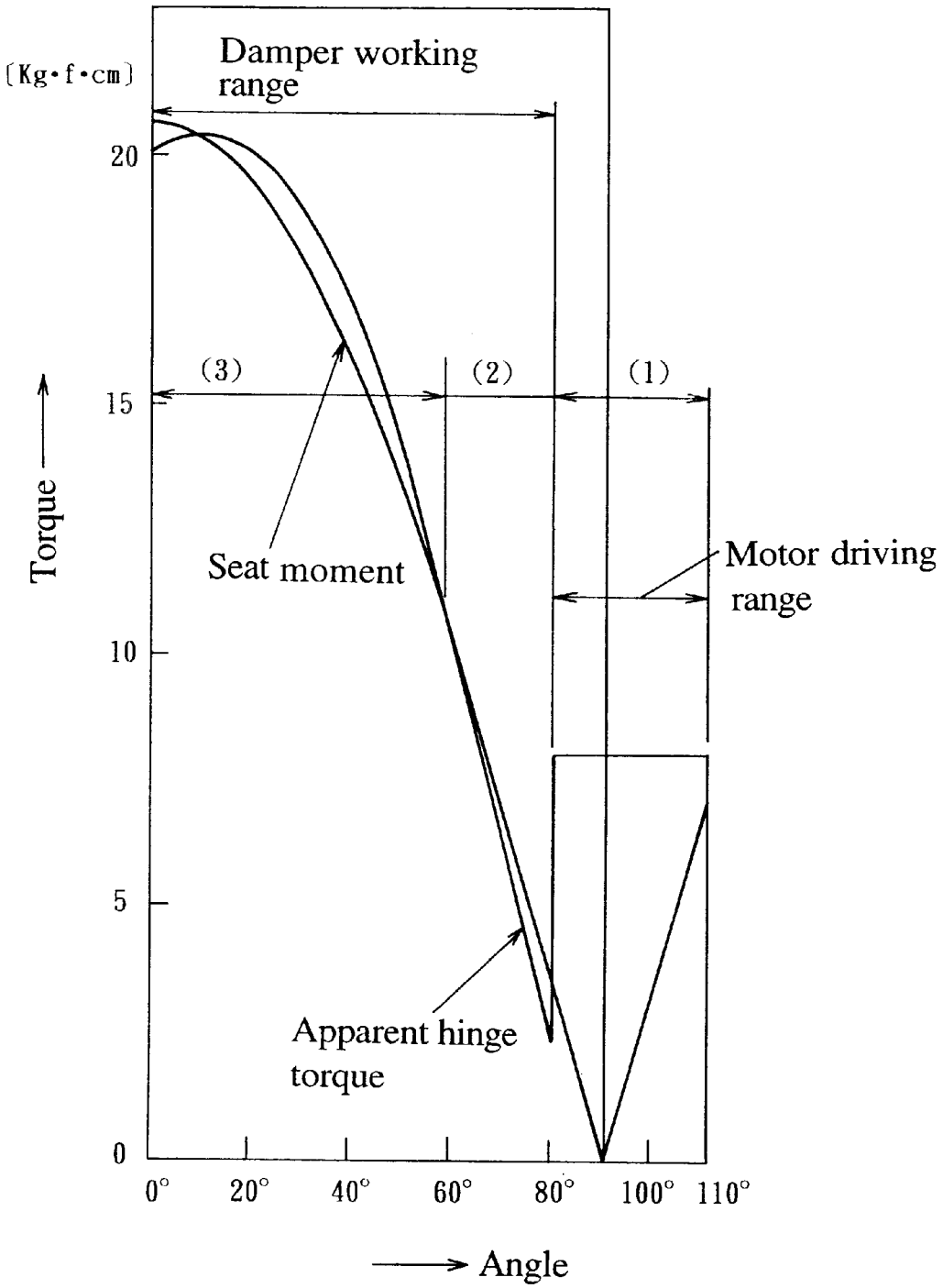
FIG. 9 graphically shows the torque change of the semi-automatic operator.

The semi-automatic operator of the present invention, having been described in the foregoing, functions as will be discussed herebelow with reference to FIGS. 8 and 9 being a functional chart, and a graph of torque change, respectively, of the semi-automatic operator.

The movement of the seat 4 will be described with reference to FIG. 8. First, the user opens the seat 4 by hand. The seat 4 will be stopped at a full opened position of 110 degrees beyond which the seat 4 cannot be opened any more. At this time, a rotating torque is transmitted to the damper 18 and torque transmission gear 14 via the output gear 15 which rotates with the seat 4. Since the valves 22 allow the viscous fluid 29 to smoothly pass, the damper 18 will have the internal mechanism not broken. On the other hand, when applied with an excessive torque, the torque transmission gear 14 will idle independently of the output gear 15 and stops from rotating, which will also contribute to the prevention of the reduction mechanism composed of the reduction gears 11, 12 and 13 from being broken. In a predetermined time after the user of the toilet bowl leaves the toilet bowl with the seat 4 and thus the seat lid 5 not closed, the motor 10 will automatically be put into action. The predetermined time is counted when the seat 4 is stopped at the full opened position of 110 degrees or after the user leaves the toilet bowl.

Then, the torque of the motor 10 is transmitted to the torque transmission gear 14 via the first, second and third reduction gears 11, 12 and 13, then from the torque transmission gear 14 to the output gear 15, and further from the output gear 15 to the seat 4 via the rotating shaft 16 and output shaft 3. Thus the seat 4 is turned in the closing direction. The seat 4 will be turned continuously in a range from the full opened position of 110 degrees over a self-standing angle of 90 degrees to an angle of 80 degrees. That is to say, when the seat 4 is turned to the opened angle of 80 degrees, the motor 10 is automatically stopped from running. The reason for this turning of the seat 4 by the motor 10 to the opened angle of 80 degrees is that this opened angle of 80 degrees is an angle at which the dead weight of the seat 4 positively allows the seat 4 itself to start turning in the closing direction, or which is beyond the moment reversal point where the moment of the seat 4 will be reversed. This movement of the seat 4 corresponds to a range of operation (1) in FIG. 9.

When the seat 4 is opened to the angle of 80 degrees at which it can be turned due to its dead weight in the closing direction and the motor 10 is stopped from running as mentioned above, the seat 4 will duly start turning in the closing direction under its dead weight. At this time, the moment of the seat 4 is rather small. However, the seat will continuously turn in the closing direction. Since the torque of the fluid damper 18 against the turning of the seat 4 is yet smaller than the moment of the seat 4 at this stage of movement, there is a tendency that the turning of the seat 4 is accelerated. This movement corresponds to a range of operation (2) in FIG. 9.

As the seat 4 is turned at a higher speed due to the acceleration, the torque of the fluid damper 18 will be correspondingly greater and exceed the moment of the seat 4. As a result, the turning of the seat 4 will shift from the phase of acceleration to a phase of deceleration. The seat 4 slows down and is finally closed softly. That is, the damping by the fluid damper 18 allows the seat 4 to close softly.

The fluid damper 18 works as will be described below:

As the seat 4 is turned, the correspondingly rotating output gear 15 will rotate the damper gear 19 and thus the rotating shaft 21. The rotation of the rotating shaft 21 causes the valve core 27 to oscillate from the cut 26 through the elongated recess 24 to the slot 25 which will thus be sealed by the valve core 27. Then, the viscous fluid 29 can move only through a clearance between the inner wall of the damper case 20 and the vane 23, which will provide a damping action. The movement of the seat 4 during which the torque of the fluid damper 18 exceeds the moment of the seat 4 corresponds to a range of operation (3) in FIG. 9.

It should be noted that when an abnormal operation takes place or when the torque of the motor 10 has become abnormally great, for example, even if the torque has been transmitted to the torque transmission gear 14 via the reduction gears 11, 12 and 13, it will not be transmitted from the torque transmission gear 14 to the output gear 15. Namely, the torque transmission gear 14 will rotate idly. This is because a torque is transmitted from the torque transmission gear 14 to the output gear 15 through a connection between the torque transmission gear 14 and output gear 15, established when the torque transmission gear 14 is pressed to the output gear 15 by the coil spring 17. No torque can be transmitted unless there is an engagement between the gears 14 and 15. More particularly, the torque transmission gear 14, output gear 15 and coil spring 17 form together the torque limiter T. A torque whose magnitude is over a value limited by the torque limiter T will not be transmitted to the output gear 15, seat 4 and fluid damper 18. Also, an abnormal torque developed at the fluid damper 18 and output gear 15 when the seat 5 is closed by hand will not be transmitted to the torque transmission gear 14. Therefore, an abnormal torque, if any, will result in no mechanical destruction or fault in the semi-automatic operator according to the present invention.

In the foregoing, only the right-side operator B for use with the seat 4 has been described concerning its function. Also the left-side operator B for use with the seat lid 5 will start operating when the seat lid 5 is opened from the closed position as shown in FIG. 2. The operator B for the seat lid 5 is basically identical in construction and function to the operator B for the seat 4. Therefore, the construction and function of the operator B for the seat lid 5 will not further be described.

What is claimed is:

1. A semi-automatic operator for a toilet bowl seat or seat lid comprising:

a hinge case installed on a toilet bowl body;

a rotating shaft supporting one of a seat and seat lid of the toilet bowl openably and closeably;

an output gear mounted on the rotating shaft;

a fluid damper having a damper gear in mesh with the output gear;

a reduction gear coupled to the output gear by means of a torque limiter;

a motor coupled to the reduction gear; and a drive circuit for driving the motor in a range from an opened angle to a predetermined closed angle of the seat or seat lid, the drive circuit being provided with a sensor to detect an operation made to open the seat or seat lid, and a timer which is turned on by the sensor to turn on the drive circuit after a predetermined time following the sensor detecting the operation.

2. A semi-automatic operator for a toilet bowl seat or seat lid comprising:

a hinge case installed on a toilet bowl body;

a rotating shaft mounted on the hinge case;

an output shaft inserted axially into the rotating shaft, the output shaft secured at one end to one of the toilet bowl seat and the seat lid, the other end of the output shaft rotatably supporting the other of the toilet bowl seat and seat lid;

an output gear mounted on the rotating shaft, a fluid damper having a damper gear in mesh with the output gear;

a reduction gear coupled to the output gear by means of a torque limiter;

a motor coupled to the reduction gear; and a drive circuit for driving the motor in a range from an opened angle to a predetermined closed angle of the seat or lid, the drive circuit being provided with a sensor to detect an operation made to open the seat or seat lid and a timer turned on by the sensor for turning on the drive circuit at a predetermined time following the sensor detecting the operation.

3. A semi-automatic operator for a toilet bowl seat or seat lid comprising:

a hinge case installed on a toilet bowl body;

a rotating shaft supporting one of a seat and seat lid of the toilet bowl openably and closeably;

an output gear mounted on the rotating shaft;

a fluid damper having a damper gear in mesh with the output gear;

a reduction gear assembly coupled to the output gear by means of a torque limiter, the torque limiter including a torque transmission gear of the reduction gear, rotatably mounted on the rotating shaft having the output gear mounted thereon, and a compression spring wound on the rotating shaft to press the torque transmission gear to the output gear;

a motor coupled to the reduction gear assembly; and a drive circuit for driving the motor in a range from an opened angle to a predetermined closed angle of the seat or seat lid, the drive circuit being provided with a sensor to detect an operation made to open the seat or seat lid, and a timer which is turned on by the sensor to turn on the drive circuit after a predetermined time following the sensor detecting the operation.

4. A semi-automatic operator for a toilet bowl seat or seat lid comprising:

a hinge case installed on a toilet bowl body;

a rotating shaft mounted on the hinge case;

an output shaft inserted axially into the rotating shaft, the output shaft secured at one end to one of the toilet bowl seat and the seat lid, the other end of the output shaft rotatably supporting the other of the toilet bowl seat and seat lid;

an output gear mounted on the rotating shaft, a fluid damper having damper gear in mesh with the output gear;

a reduction gear assembly coupled to the output gear by means of a torque limiter, the torque limiter including a torque transmission gear of the reduction gear assembly rotatably mounted on the rotating shaft having the output gear mounted thereon, and a compression spring wound on the rotating shaft to press the torque transmission gear to the output gear;

a motor coupled to the reduction gear assembly; and a drive circuit for driving the motor in a range from an opened angle to a predetermined closed angle of the seat or lid, the drive circuit being provided with a sensor to detect an operation made to open the seat or seat lid and a timer turned on by the sensor for turning on the drive circuit at a predetermined time following the sensor detecting the operation.

* * * * *